US009159237B2

(12) United States Patent
Huang

(10) Patent No.: US 9,159,237 B2
(45) Date of Patent: Oct. 13, 2015

(54) VEHICLE EARLY WARNING SYSTEM AND VEHICLE EARLY WARNING METHOD

(71) Applicant: Wistron Corporation, New Taipei (TW)

(72) Inventor: Chi-Fa Huang, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 33 days.

(21) Appl. No.: 14/284,432

(22) Filed: May 22, 2014

(65) Prior Publication Data

US 2015/0130600 A1 May 14, 2015

(30) Foreign Application Priority Data

Nov. 11, 2013 (TW) ..... 102140918 U

(51) Int. Cl.
*G08G 1/16* (2006.01)
*G08G 1/0965* (2006.01)

(52) U.S. Cl.
CPC ..... *G08G 1/166* (2013.01)

(58) Field of Classification Search
CPC ..... G08G 1/16; G08G 1/165; G08G 1/166; G08G 1/0965; B60W 30/08; B60W 30/085; B60W 30/09; B60W 30/095
USPC ..... 340/435, 436, 438, 439; 701/70, 301
See application file for complete search history.

(56) References Cited

U.S. PATENT DOCUMENTS

| | | | | |
|---|---|---|---|---|
| 6,933,837 | B2 * | 8/2005 | Gunderson et al. | 340/436 |
| 7,099,776 | B2 | 8/2006 | King et al. | |
| 2008/0084283 | A1 * | 4/2008 | Kalik | 340/435 |
| 2010/0106387 | A1 * | 4/2010 | Tsuchida | 701/70 |
| 2014/0025285 | A1 * | 1/2014 | Trombley | 701/301 |
| 2014/0125473 | A1 * | 5/2014 | Cund et al. | 340/435 |
| 2014/0207364 | A1 * | 7/2014 | Eidehall et al. | 701/301 |

* cited by examiner

*Primary Examiner* — Hung T Nguyen
(74) *Attorney, Agent, or Firm* — McClure, Qualey & Rodack, LLP

(57) ABSTRACT

A vehicle early warning system and a vehicle early warning method are provided. The vehicle early warning system comprises an inter-vehicle communication device, a processor and a notice device. The inter-vehicle communication device receives an other-vehicle message package having an other-vehicle identification code and an other-vehicle sense message. The processor determines whether the other-vehicle identification code is valid. The processor determines whether the other-vehicle sense message is valid when the other-vehicle identification code is valid. The processor determines whether a driving location is on a predicated collision path according to the other-vehicle sense message when the other-vehicle sense message is valid. The notice device outputs a notice signal when the driving location is on a predicated collision path.

20 Claims, 5 Drawing Sheets

VEHICLE EARLY WARNING SYSTEM AND VEHICLE EARLY WARNING METHOD

This application claims the benefit of Taiwan application Serial No. 102140918, filed Nov. 11, 2013, the subject matter of which is incorporated herein by reference.

BACKGROUND OF THE INVENTION

1. Field of the Invention

The invention relates in general to an electronic device, and more particularly to a vehicle early warning system and a vehicle early warning method.

2. Description of the Related Art

In recent years, many countries are dedicated to the development of vehicle collision avoidance system for improving transport safety. Of the technologies widely used in the driving system, the technology fields such as collision avoidance radar, laser and video recorder have gained great popularity. The function of collision avoidance radar, laser and video recorder mainly cover the driver's blind spot region and assist the driver to take necessary measures to avoid the occurrence of collision. In a traffic environment with large traffic flow, when the vehicle ahead brakes, the vehicle behind tends to over-react to the brake, and may easily result in collision regardless the speed of traffic being low or high. Vehicles collide partly due to the following distance being too short but largely due to the driver's response being too late.

However, the vehicle collision avoidance system using collision avoidance radar, laser and video recorder can only detect the approach of adjacent vehicles, but can do nothing with the vehicles in the blind spot region. For instance, when the second vehicle ahead collides with the third vehicle ahead, the vehicle collision avoidance system cannot provide any warning whether the vehicle is equipped with collision avoidance radar, laser or video recorder.

SUMMARY OF THE INVENTION

The invention is directed to a vehicle early warning system and a vehicle early warning method capable of reminding the drivers by using an other-vehicle message package so that the driver can early respond to potential dangers.

According to one embodiment of the present invention, a vehicle early warning method is provided. The vehicle early warning method comprises following steps. An other-vehicle message package having an other-vehicle identification code and an other-vehicle sense message is received. Whether the other-vehicle identification code is valid is determined. Whether the other-vehicle sense message is valid is determined when the other-vehicle identification code is valid. Whether a driving location is on a predicated collision path is determined according to the other-vehicle sense message when the other-vehicle sense message is valid. A notice signal is outputted when the driving location is on a predicated collision path.

According to another embodiment of the present invention, a vehicle early warning system is provided. The vehicle early warning system comprises an inter-vehicle communication device, a processor and a notice device. The inter-vehicle communication device receives an other-vehicle message package having an other-vehicle identification code and an other-vehicle sense message. The processor determines whether the other-vehicle identification code is valid. The processor determines whether the other-vehicle sense message is valid when the other-vehicle identification code is valid. The processor determines whether a driving location is on a predicated collision path according to the other-vehicle sense message when the other-vehicle sense message is valid. The notice device outputs a notice signal when the driving location is on a predicated collision path.

The above and other aspects of the invention will become better understood with regard to the following detailed description of the preferred but non-limiting embodiment (s). The following description is made with reference to the accompanying drawings.

DETAILED DESCRIPTION OF THE INVENTION

Figure 1:
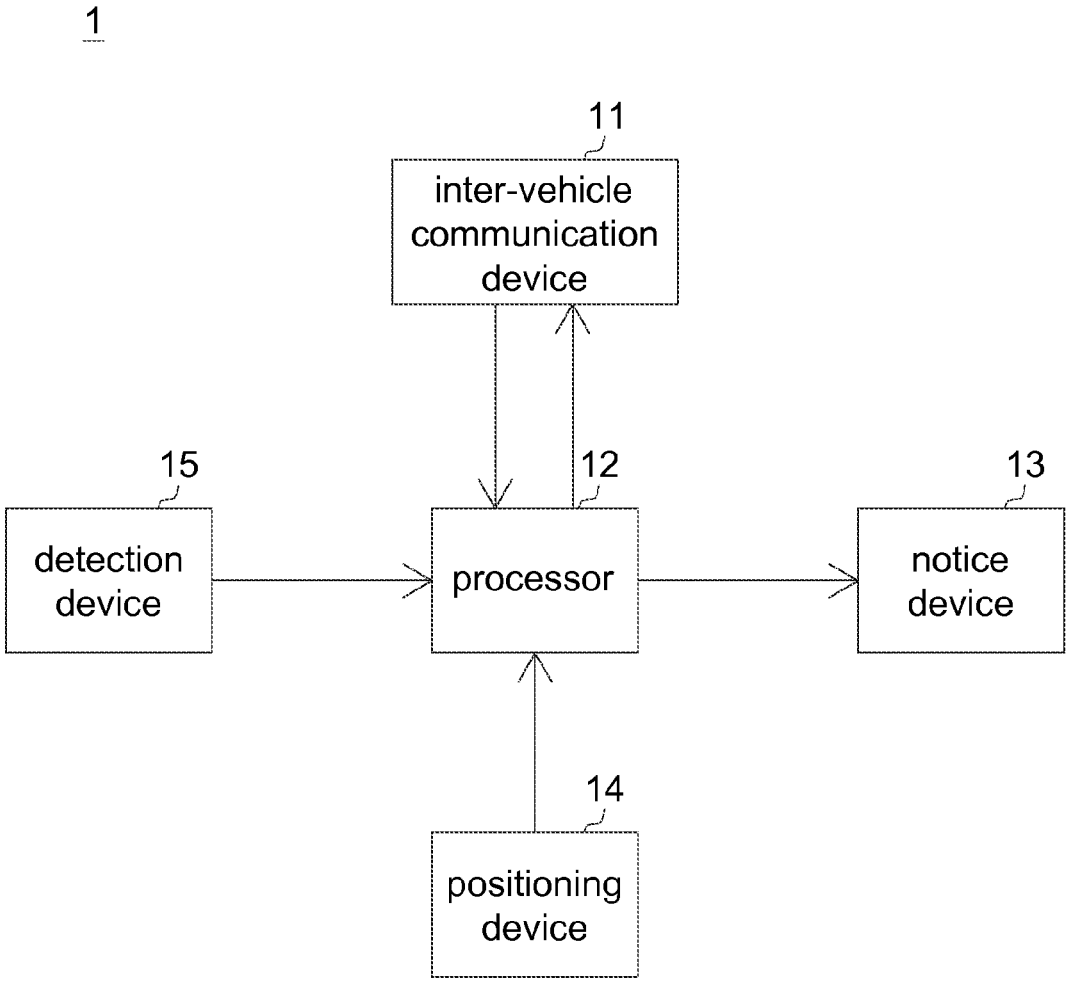
FIG. 1 is a block diagram of a vehicle early warning system according to an embodiment of the invention.

Referring to FIG. 1, a block diagram of a vehicle early warning system according to an embodiment of the invention is shown. The vehicle early warning system 1 is used in vehicles, and comprises an inter-vehicle communication device 11, a processor 12, a notice device 13, a positioning device 14 and a detection device 15. The inter-vehicle communication device 11 receives an other-vehicle message package or transmits a vehicle message package. The inter-vehicle communication device 11 comprises an antenna and a communication module, and a communication module dedicated short range communication (DSRC) module. The wireless access in vehicular environments (WAVE) is used in the DSRC module. The processor 12 determines whether a driving location is on a predicated collision path, or generates a vehicle message package. The notice device 13 outputs a notice signal when the driving location is on a predicated collision path. The notice device 13 can be realized by such as screen, light emitting diode or speaker. The notice signal can be realized by such as text, pattern, voice or indicator. The positioning device 14 provides a driving location such as a global positioning system (GPS) or an on-board unit (OBU). The detection device 15 provides a vehicle condition. The detection device 15 comprises a front collision warning system (FCWS), a blind spot detection and warning system (BDWS), and a rear collision warning system (ROWS). The front collision warning system, the blind spot detection and warning system, and the rear collision warning system detect a distance between the vehicle and its adjacent vehicle to generate a vehicle condition. Or, the detection device 15 detects the action of airbag, emergency brake or hand brake to generate a vehicle condition.

Figure 2:
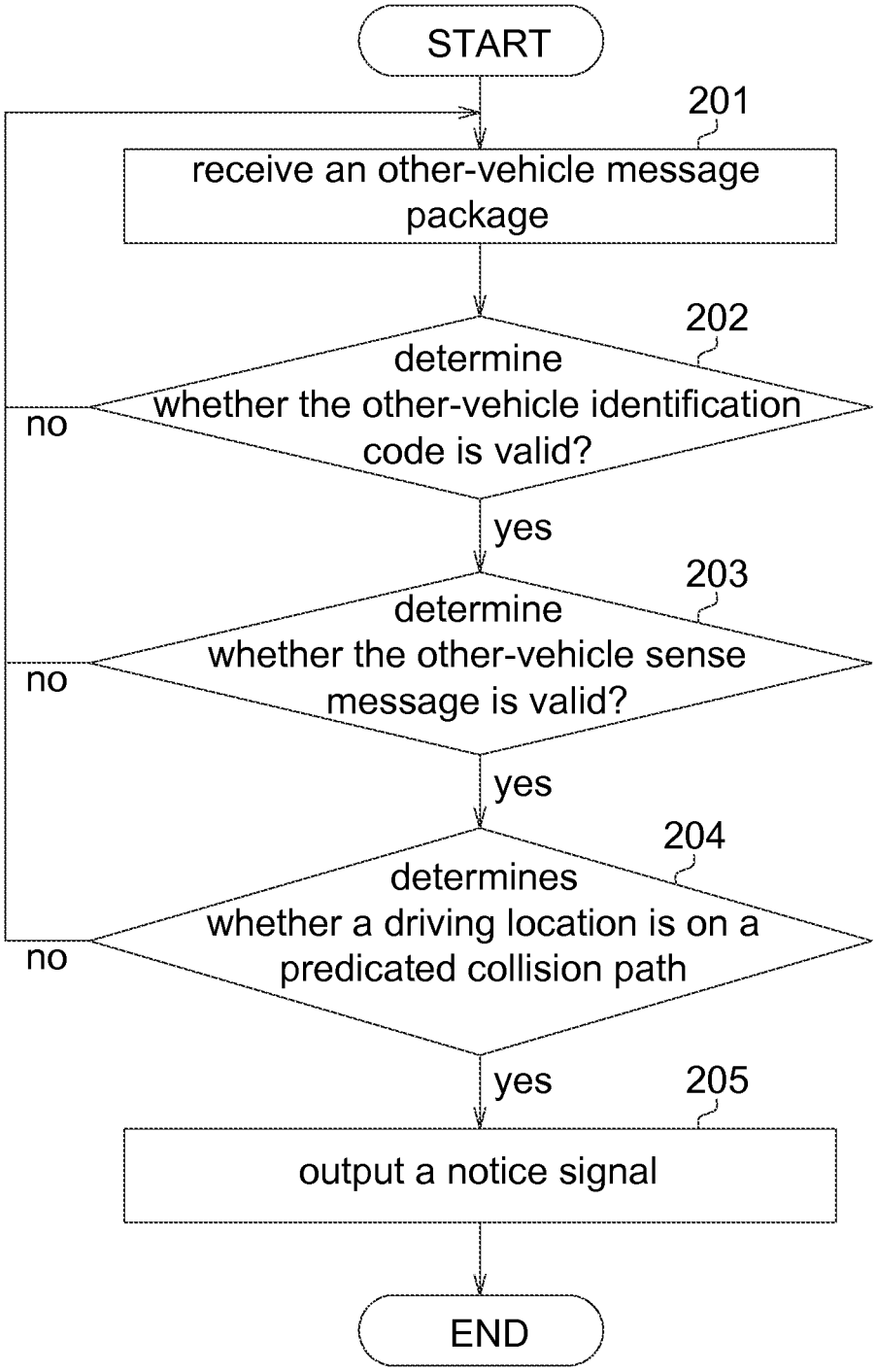
FIG. 2 is a flowchart of a vehicle early warning system outputting a notice signal according to an other-vehicle message package.

Referring to both FIG. 1 and FIG. 2. FIG. 2 is a flowchart of a vehicle early warning system outputting a notice signal according to an other-vehicle message package. The vehicle early warning method of the vehicle early warning system 1 comprises steps of outputting a notice signal according to an other-vehicle message package; generating a vehicle message package according to a vehicle condition. FIG. 2 is exemplified by the vehicle early warning system 1 outputting a notice signal according to an other-vehicle message package. Firstly, the method begins at step 201, the inter-vehicle communication device 11 receives an other-vehicle message package having an other-vehicle identification code and an other-vehicle sense message. Next, the method proceeds to step 202, the processor 12 determines whether the other-vehicle identification code is valid. If the other-vehicle identification code is not valid, then the method repeats step 201 to receive an other other-vehicle message package; if the other-vehicle identification code is valid, then the method executes step 203. In step 203, the processor 12 determines whether the other-vehicle sense message is valid. If the other-vehicle sense message is not valid, then the method repeats step 201 to receive other other-vehicle message package; if the other-vehicle sense message is valid, then the method executes step 204. In step 204, the processor 12 determines whether a driving location is on a predicated collision path according to the other-vehicle sense message. If the driving location is not on a predicated collision path, then the method repeats step 201 to receive other other-vehicle message package; if the driving location is on a predicated collision path, then the method executes step 205. In step 205, the notice device 13 outputs a notice signal.

Furthermore, the other-vehicle sense message has an other-vehicle warning identification code and an other-vehicle location. The processor 12 determines whether a driving location is on a predicated collision path according to the other-vehicle warning identification code and the other-vehicle location. The processor 12 further determines whether the other-vehicle warning identification code belongs to an emergent electronic brake warning, a front collision warning, a rear collision warning, a left side collision warning, a right side collision warning, a head-on collision warning or an intersection collision warning. Besides, the notice device 13 outputs different notice signals according to a hazard level. For instance, the notice signal outputted by the notice device 13 is an alerting signal when the distance between the driving location and the other-vehicle location is within an alerting range such as between 5m~100m. the notice signal outputted by the notice device 13 is a warning signal when the distance between the driving location and the other-vehicle location is within a warning range such as between 100m~300m. The notice signal outputted by the notice device 13 is a reminder signal when the distance between the driving location and the other-vehicle location is within a reminder range such as between 300m~1000m. The reminder range is greater than warning range, and the warning range is greater than the alerting range. Although the disclosed embodiment is exemplified by three types of notice signal, practical application is not limited thereto. In other embodiments, the hazard level based on the distance between the driving location and the other-vehicle location can be divided into more categories each corresponding to one type of notice signal.

Figure 3:
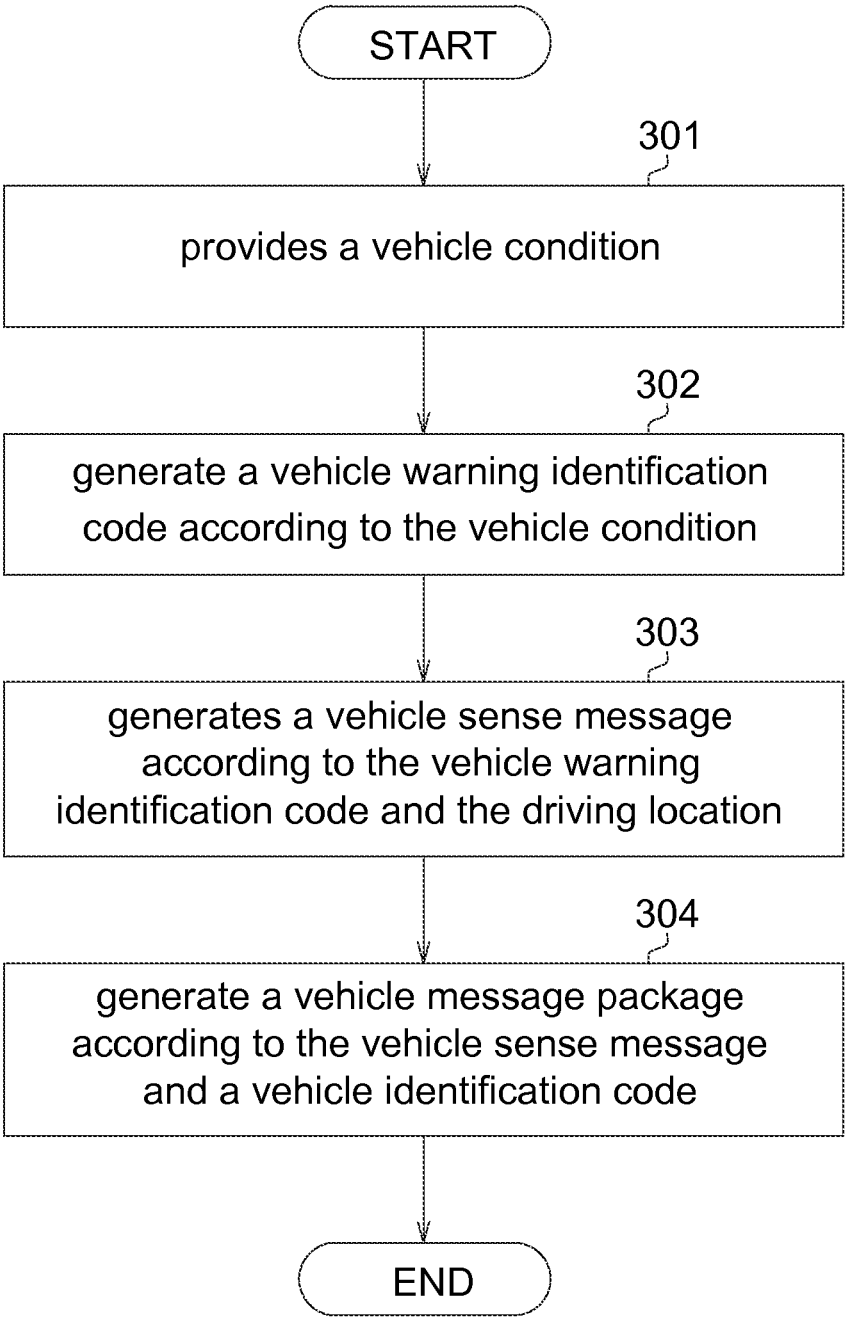
FIG. 3 is a flowchart of a vehicle early warning system generating a vehicle message package according to the vehicle condition.

Referring to both FIG. 1 and FIG. 3. FIG. 3 is a flowchart of a vehicle early warning system generating a vehicle message package according to the vehicle condition. FIG. 3 is exemplified by the vehicle early warning system 1 generating a vehicle message package according to a vehicle condition. Firstly, the method begins at step 301, the detection device 15 provides a vehicle condition. Next, the method proceeds to step 302, the processor 12 generates a vehicle warning identification code according to the vehicle condition. Then, the method proceeds to step 303, the processor 12 generates a vehicle sense message according to the vehicle warning identification code and the driving location. Then, the method proceeds to step 304, the processor 12 generates a vehicle message package according to the vehicle sense message and a vehicle identification code.

Figure 4:
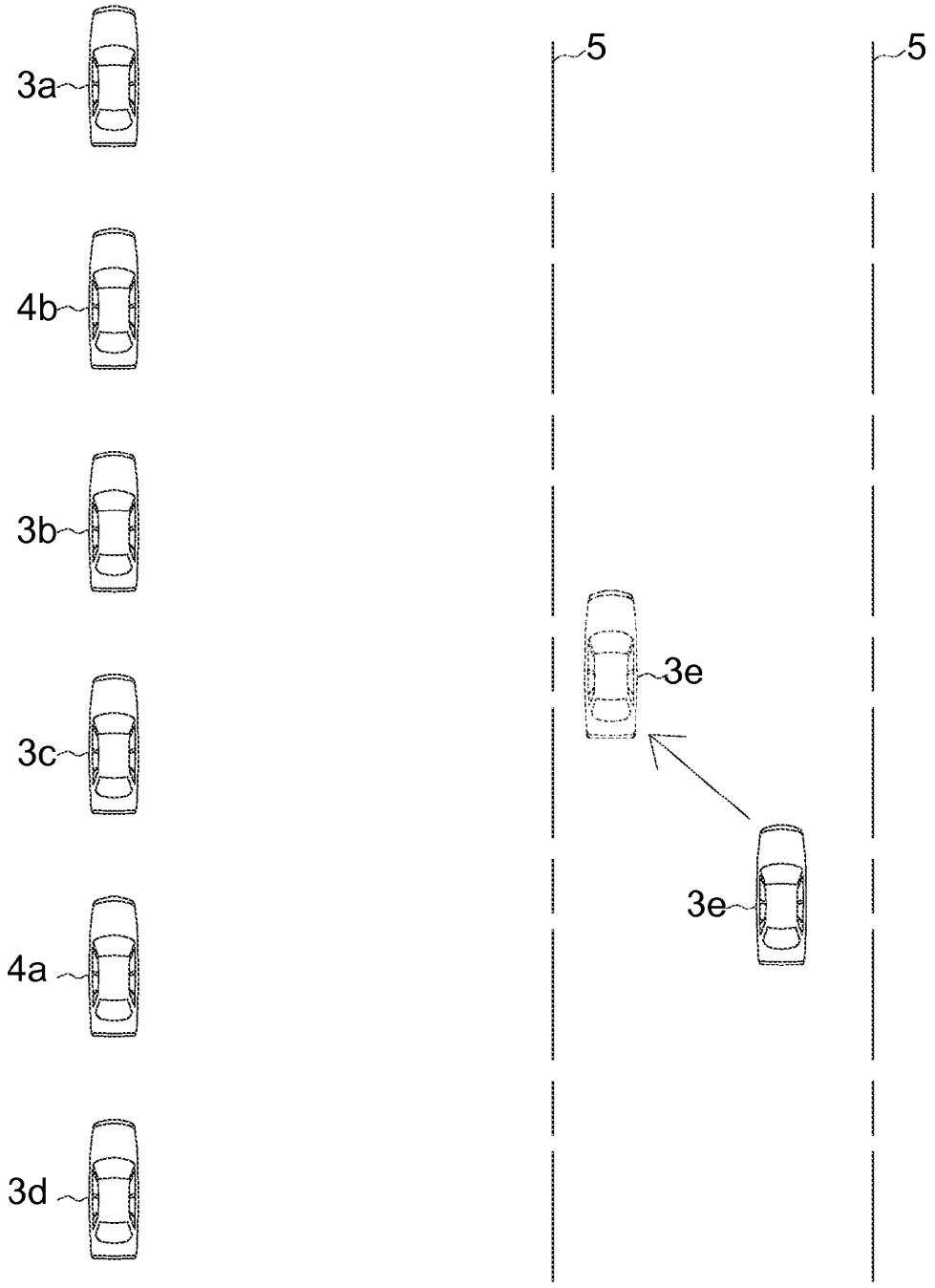
FIG. 4 is a scenario of a vehicle early warning system.

Referring to FIG. 4, a scenario of a vehicle early warning system is shown. For instance, both vehicles 4*a* and 4*b* are equipped with a vehicle early warning system, while vehicles 3*a*, 3*b*, 3*c*, 3*d* and 3*e* are not equipped with the vehicle early warning system. When the distance between the vehicle 4*b* and the front vehicle 3*a* is between 5m~50m, the vehicle 4*b* generates a vehicle message package and broadcasts the vehicle message package according to the vehicle sense message and the vehicle identification code. The vehicle message package generated by the vehicle 4*b* is the other-vehicle message package received by the vehicle 4*a*. When the vehicles 3*b* and 3*c* are between the vehicles 4*a* and 4*b*, the vehicle 4*a* instantly receives the other-vehicle message package from the vehicle 4*b*, hence avoiding the occurrence of pileup.

Likewise, when the distance between the vehicle 4*a* and its rear vehicle 3*d* is between 5m~50m, the vehicle 4*a* generates a vehicle message package and broadcasts vehicle message package the according to the vehicle sense message and the vehicle identification code. The vehicle message package generated by vehicle 4*a* is the other-vehicle message package received by the vehicle 4*b*. When the vehicles 3*b* and 3*c* are between the vehicles 4*a* and 4*b*, the vehicle 4*b* instantly receives the other-vehicle message package from the vehicle 4*a*, hence avoiding the occurrence of pileup. Moreover, when the vehicle 3*e* crosses over the lane and approaches the vehicle 4*b*, the vehicle 4*a* will instantly receive the other-vehicle message package from the vehicle 4*b*, hence avoiding potential collision.

Figure 5:
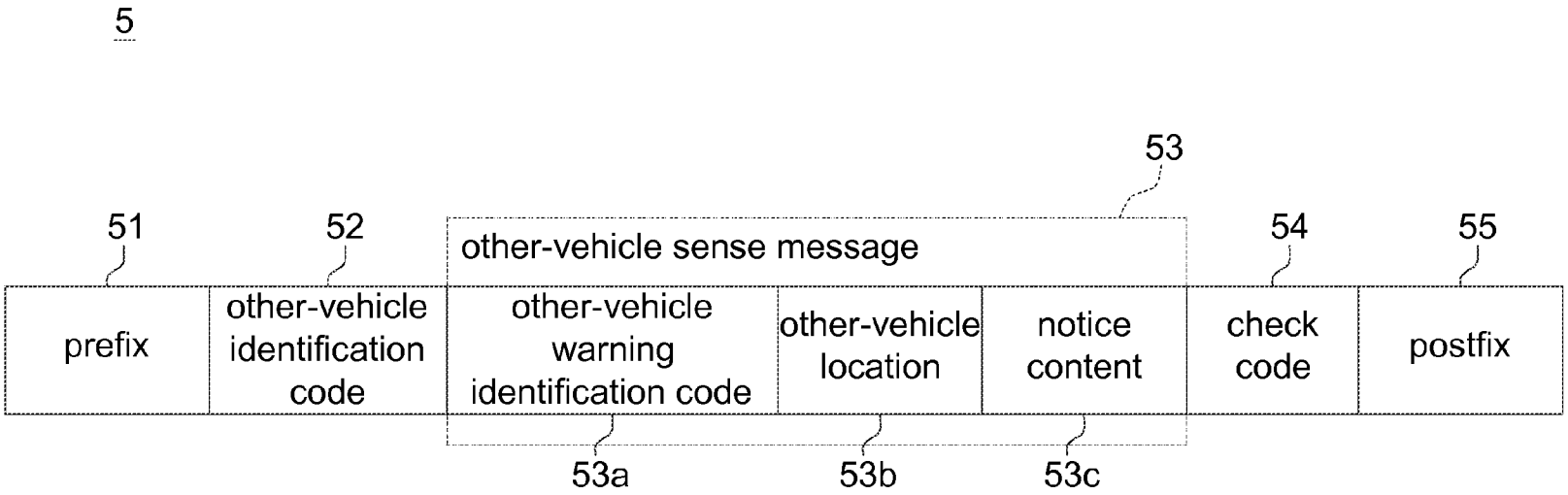
FIG. 5 is a schematic diagram of an other-vehicle message package.

Referring to FIG. 5, FIG. 5 is a schematic diagram of an other-vehicle message package. The other-vehicle message package 5 and the vehicle message package share the same format. For the convenience of description, FIG. 5 is exemplified by the other-vehicle message package 5. The other-vehicle message package 5 has a prefix 51, an other-vehicle identification code 52, an other-vehicle sense message 53, a check code 54 and a postf ix 55. The prefix 51 and the postf ix 55 respectively represent the start and the end of the other-vehicle message package 5. The vehicle early warning system determines whether the vehicle broadcasting the other-vehicle message package 5 is valid according to the other-vehicle identification code 52. The vehicle early warning system can be equipped with a valid identification code database. When the other-vehicle identification code 52 matches one of the valid identification codes of the valid identification code database, this indicates that the other-vehicle identification code 52 is valid.

The check code 54 can be realized by such as a cyclic redundancy check (CRC) for checking whether the other-vehicle message package 5 is erroneous. The other-vehicle sense message 53 further has an other-vehicle warning identification code 53*a*, an other-vehicle location 53*b* and a notice content 53*c*. The other-vehicle warning identification code 53*a* is such as an emergent electronic brake warning, a front collision warning, a rear collision warning, a left side collision warning, a right side collision warning, a head-on collision warning or an intersection collision warning. The other-vehicle location 53*b* indicates the location of the vehicle broadcasting the other-vehicle message package 5. The notice content 53*c* is the content of the notice signal. For instance, the notice device notices the user of a collision 10m ahead by sending an audio or a video message.

The vehicle early warning system and the vehicle early warning method disclosed in above embodiments are capable of outputting a notice signal to notice the driver by using an other-vehicle message package broadcasted by an other vehicle so that the driver can early respond to potential dangers. Thus, the driver of the vehicle behind the other vehicle can be instantly reminded of the traffic condition, hence avoiding the occurrence of pileup and improving transport safety.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A vehicle early warning method, comprising:

receiving an other-vehicle message package having an other-vehicle identification code and an other-vehicle sense message;

determining whether the other-vehicle identification code is valid;

determining whether the other-vehicle sense message is valid when the other-vehicle identification code is valid;

determining whether a driving location is on a predicted collision path according to the other-vehicle sense message when the other-vehicle sense message is valid; and outputting a notice signal when the driving location is on the predicted collision path.

2. The vehicle early warning method according to claim 1, wherein the other-vehicle sense message has an other-vehicle warning identification code and an other-vehicle location, the step of determining the predicted collision path determines whether the driving location is on the predicted collision path according to the other-vehicle warning identification code and the other-vehicle location.

3. The vehicle early warning method according to claim 2, wherein the step of determining the predicted collision path further determines whether the other-vehicle warning identification code belongs to an emergent electronic brake warning, a front collision warning, a rear collision warning, a left side collision warning, a right side collision warning, a head-on collision warning or an intersection collision warning.

4. The vehicle early warning method according to claim 3, wherein the notice signal is a alerting signal when the distance between the driving location and the other-vehicle location is within an alerting range, the notice signal is a warning signal when the distance between the driving location and the other-vehicle location is within a warning range, the notice signal is a reminder signal when the distance between the driving location and the other-vehicle location is within a reminder range, the reminder range is greater than the warning range, and the warning range is greater than the alerting range.

5. The vehicle early warning method according to claim 4, further comprising:

providing a vehicle condition through a detection device;

generating a vehicle warning identification code according to the vehicle condition;

generating a vehicle sense message according to the vehicle warning identification code and the driving location; and generating a vehicle message package according to the vehicle sense message and a vehicle identification code.

6. The vehicle early warning method according to claim 5, wherein the detection device comprises a front collision warning system, a blind spot detection and warning system and a rear collision warning system.

7. The vehicle early warning method according to claim 6, wherein the driving location is provided by a positioning device.

8. The vehicle early warning method according to claim 7, wherein the positioning device is a global positioning system (GPS).

9. The vehicle early warning method according to claim 7, wherein the positioning device is an on-board unit (OBU).

10. The vehicle early warning method according to claim 1, further comprising:

providing a vehicle condition through a detection device;

generating a vehicle warning identification code according to the vehicle condition;

generating a vehicle sense message according to the vehicle warning identification code and the driving location; and generating a vehicle message package according to the vehicle sense message and a vehicle identification code.

11. A vehicle early warning system, comprising:

an inter-vehicle communication device for receiving an other-vehicle message package having an other-vehicle identification code and an other-vehicle sense message;

a processor for determining whether the other-vehicle identification code is valid, wherein the processor determines whether the other-vehicle sense message is valid when the other-vehicle identification code is valid, and determines whether a driving location is on a predicted collision path according to the other-vehicle sense message when the other-vehicle sense message is valid; and a notice device for outputting a notice signal when the driving location is one the predicted collision path.

12. The vehicle early warning system according to claim 11, wherein the other-vehicle sense message has an other-vehicle warning identification code and an other-vehicle location, and the processor determines whether the a driving location is one the predicted collision path according to the other-vehicle warning identification code and the other-vehicle location.

13. The vehicle early warning system according to claim 12, wherein the step of determining the predicted collision path further determines whether the other-vehicle warning identification code belongs to an emergent electronic brake warning, a front collision warning, a rear collision warning, a left side collision warning, a right side collision warning, a head-on collision warning or an intersection collision warning.

14. The vehicle early warning system according to claim 13, wherein the notice signal is an alerting signal when the distance between the driving location and the other-vehicle location is within a alerting range, the notice signal is a warning signal when the distance between the driving location and the other-vehicle location is within a warning range, the notice signal is a reminder signal when the distance between the driving location and the other-vehicle location is within a reminder range, the reminder range is greater than the warning range, and the warning range is greater than the alerting range.

15. The vehicle early warning system according to claim 14, further comprising:

a detection device for providing a vehicle condition, wherein the processor generates a vehicle warning identification code according to the vehicle condition, generates a vehicle sense message according to the vehicle warning identification code and the driving location, and generates a vehicle message package according to the vehicle sense message and a vehicle identification code.

16. The vehicle early warning system according to claim 15, wherein the detection device comprises a front collision warning system, a blind spot detection and warning system and a rear collision warning system.

17. The vehicle early warning system according to claim 16, further comprising:

a positioning device for providing the driving location.

18. The vehicle early warning system according to claim 17, wherein the positioning device is a global positioning system (GPS).

19. The vehicle early warning system according to claim 17, wherein the positioning device is an on-board unit (OBU).

20. The vehicle early warning system according to claim 11, further comprising:

a detection device for providing a vehicle condition, wherein the processor generates a vehicle warning identification code according to the vehicle condition, generates a vehicle sense message according to the vehicle warning identification code and the driving location, and generates a vehicle message package according to the vehicle sense message and a vehicle identification code.

* * * * *